US005967313A

United States Patent [19]

Gabriel

[11] Patent Number: 5,967,313

[45] Date of Patent: Oct. 19, 1999

[54] FLEXIBLE VACUUM PACKAGE FOR BICYCLE INNER TUBE

[75] Inventor: Jason Francis Gabriel, Gilbertsville, Pa.

[73] Assignee: Fres-co System USA, Inc., Telford, Pa.

[21] Appl. No.: 09/021,276

[22] Filed: Feb. 10, 1998

[51] Int. Cl.[6] ..... B65D 65/02; B65D 65/00

[52] U.S. Cl. ..... 206/304.1; 206/807; 206/497; 206/315.1

[58] Field of Search ..... 206/304, 304.1, 206/304.2, 497, 303, 315.1, 807

[56] References Cited

U.S. PATENT DOCUMENTS

| | | | |
|---|---|---|---|
| 2,086,179 | 7/1937 | Angier | 206/304 |
| 3,005,542 | 10/1961 | Harrison | 206/304 |
| 4,315,569 | 2/1982 | Jaeschke | 206/807 |
| 4,576,285 | 3/1986 | Goglio . | |
| 4,705,174 | 11/1987 | Goglio . | |
| 5,310,052 | 5/1994 | Bindman | 206/304.1 |
| 5,419,933 | 5/1995 | Tsukada et al. | 206/304.1 |

FOREIGN PATENT DOCUMENTS

| | | | |
|---|---|---|---|
| 1400538 | 4/1964 | France | 206/497 |

*Primary Examiner*—Paul T. Sewell
*Assistant Examiner*—J. Mohandesi
*Attorney, Agent, or Firm*—Caesar, Rivise, Bernstein, Cohen & Pokotilow, Ltd.

[57] ABSTRACT

A package for a folded inner tube for a pneumatic tire, e.g., a bicycle inner tube. The package is formed of a flexible material, and is in the form of a gussetted bag, defining a hollow interior in which the inner tube is located. The package includes plural panels or walls and a mouth which is arranged to be readily peeled open to provide access to the inner tube. When the vacuum is applied, this causes the material forming the package to closely conform to the exterior shape of the inner tube located within the package's hollow interior. This close conformance hardens the package, e.g., makes it resistant to injury. The close conformance of the walls of the package with the inner tube also causes the exterior surface of the package to assume an uneven, e.g., dimpled, state. If a wall of the package has been breached, as could occur by virtue of an impact by a sharp object, so that there is a loss of vacuum within the package, the material forming the walls of the package will tend to naturally assume their normal flat appearance. Thus, the user will be alerted to the possibility of injury to the inner tube by virtue of a smooth appearance of the package's walls.

8 Claims, 2 Drawing Sheets

FIG. 3
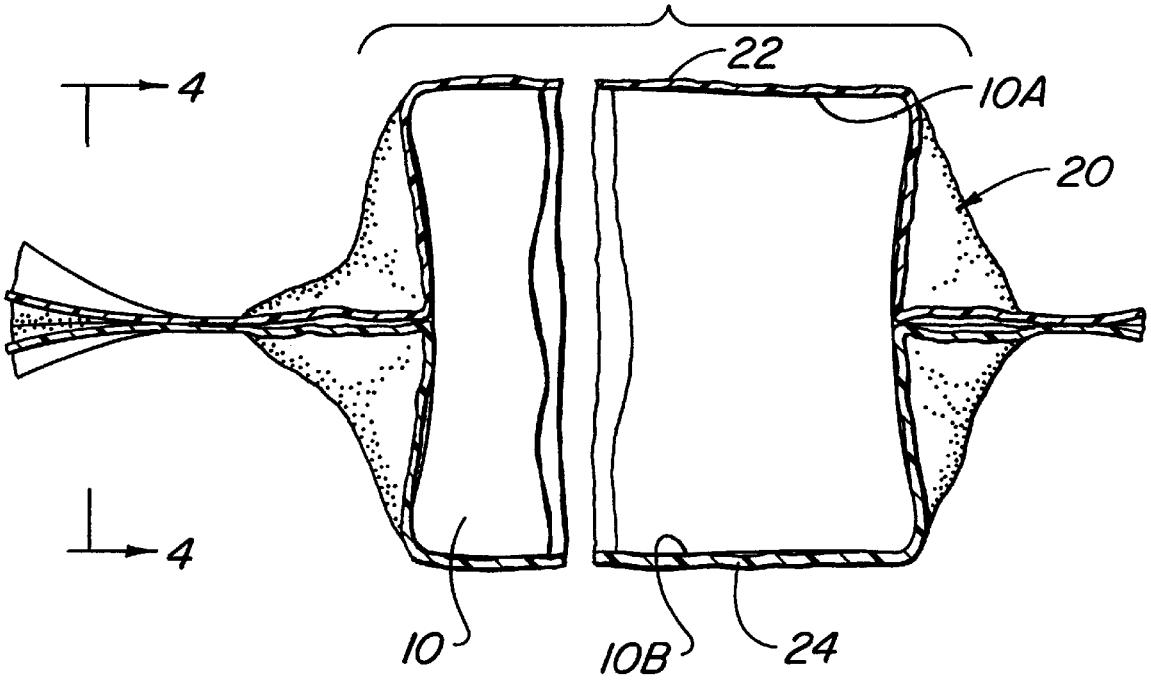
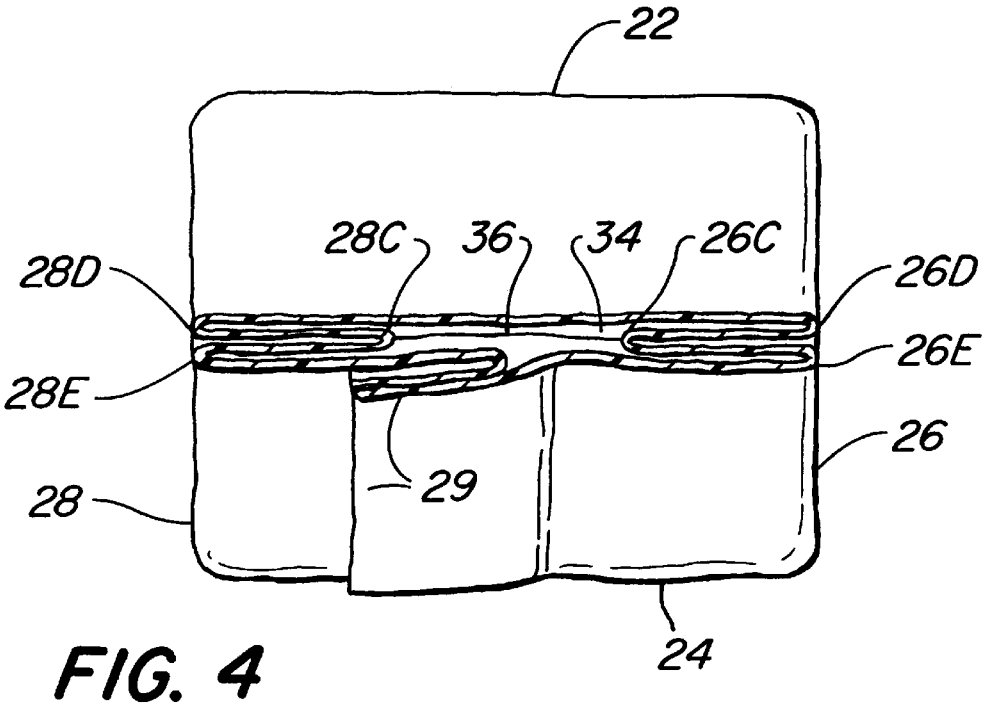
FIG. 4

FLEXIBLE VACUUM PACKAGE FOR BICYCLE INNER TUBE

BACKGROUND OF THE INVENTION

This application relates generally to flexible vacuum packages, and more particularly to flexible vacuum packages for inner tubes for pneumatic tires, such as bicycle tires.

It is a common occurrence in bicycling for a tire to become punctured, thereby necessitating its replacement or repair. Thus, bicyclists frequently carry a spare inner tube with them on a ride in case of an emergency flat tire. Current packaging for bicycle inner tubes is typically a cardboard box, with the bicycle tube commonly being folded up in the interest of compactness. While such packaging may provide some measure of protection to the inner tube from damage, it never the less still leaves something to be desired from that standpoint.

Boxes which are sufficiently rugged to prevent injury to an inner tube are commonly too heavy or bulky to be carried on a bike for many riders. Thus in order to keep weight down, many riders commonly carry a spare inner tube unprotected by any protective packaging. If the rider does keep the inner tube in its protective box, and if that box should be impacted sufficiently to injure or otherwise compromise the inner tube, that fact may not be apparent from viewing the condition of the box. Thus, a seemingly intact box, may have been impacted in such a manner that the inner tube within it has been punctured or otherwise compromised.

OBJECTS OF THE INVENTION

Accordingly, it is a general object of this invention to provide a package for inner tube for a pneumatic tire which overcomes the disadvantages of the prior art.

It is a further object of this invention to provide a package for an inner tube for a bicycle tire or any other pneumatic tire to protect the inner tube from injury.

It is a further object of this invention to provide a package for an inner tube for a bicycle tire or any other pneumatic tire to hold the inner tube in a compact condition.

It is a further object of this invention to provide a vacuum package for an inner tube for a bicycle tire or any other pneumatic tire which indicates, via the loss of vacuum, that the package has sustained some injury and that the integrity of the inner tube may be compromised.

It is still further object of this invention to provide a vacuum package for an inner tube for a bicycle tire or any other pneumatic tire which is simple in construction.

It is still further object of this invention to provide a vacuum package for an inner tube for a bicycle tire or any other pneumatic tire which is low in cost.

It is still further object of this invention to provide a vacuum package for an inner tube for a bicycle tire or any other pneumatic tire which is compact and light in weight.

SUMMARY OF THE INVENTION

These and other objects of the instant invention are achieved by providing the combination of a vacuum package and a inner tube for a vehicle. The inner tube is an annular hollow member which is folded up into a compact state, e.g., a generally parallelopiped shape.

The vacuum package is formed of at least one panel of a flexible packaging material which is configured to form a hollow interior chamber in which said folded inner tube is located. The package has a mouth arranged to enable the evacuation of air from the interior of the chamber with said folded inner tube therein and to be sealed thereafter. When evacuated and sealed the packaging material closely conforms to the shape of the folded inner tube to hold the folded inner tube in its compact state and to protect the folded inner tube from damage.

In accordance with one preferred aspect of this invention the mouth of the package is formed as a pealable sealed portion, which is arranged to be readily peeled open to provide ready access to the interior of the package to enable the folded inner tube to be removed from the package when desired.

DESCRIPTION OF THE DRAWING

FIG. 3 is a sectional view taken along line 3—3 of FIG. 1; and

FIG. 4 is an enlarged sectional view taken along line 4—4 of FIG. 3.

DETAILED DESCRIPTION OF THE PREFERRED EMBODIMENT

Figure 1:
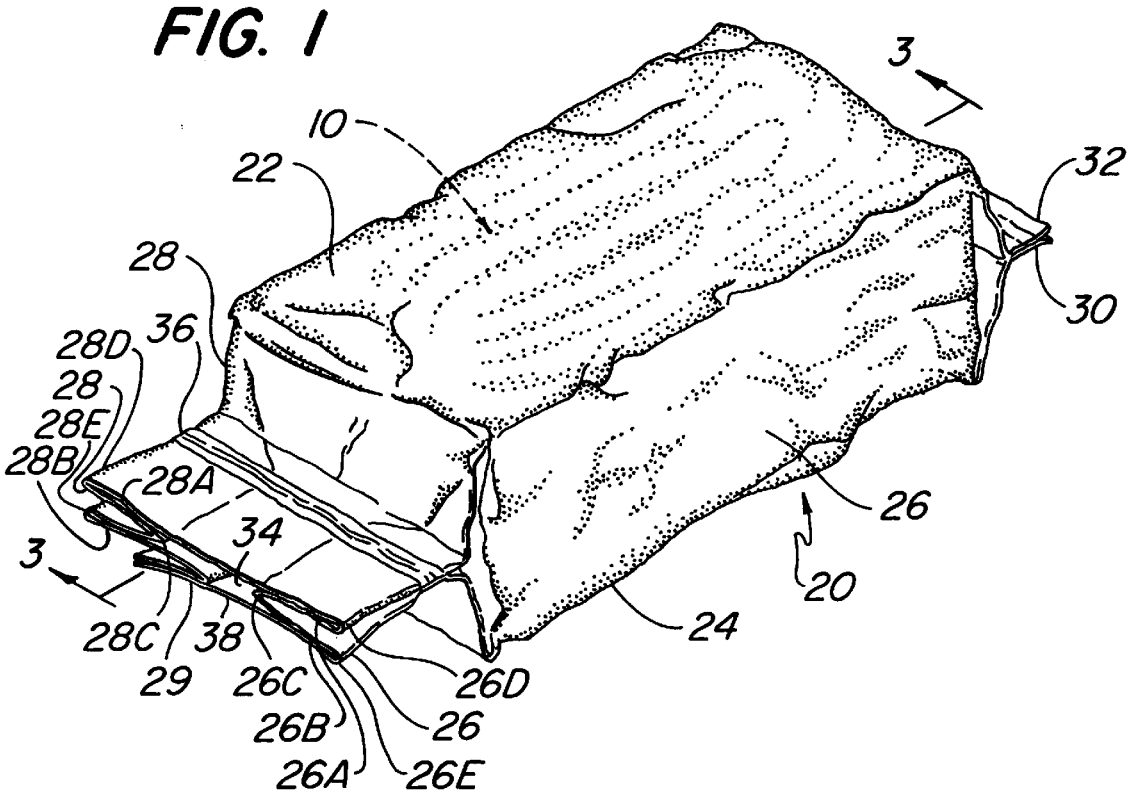
FIG. 1 is an isometric view of one exemplary package constructed in accordance with this invention shown with a conventional bicycle inner tube held therein under vacuum.

Referring to FIG. 1, there is shown at 20 in FIG. 1 a package constructed in accordance with one embodiment of this invention. The package is formed of any type of suitable flexible material stock to form a hollow container for holding any type of conventional pneumatic tire inner tube, e.g., a bicycle tire 10 (FIGS. 1 and 3), within the package under vacuum conditions. In the embodiment shown the package is of a gussetted, "brick-type" package, such as is commonly used to hold whole bean or ground coffee. This construction is merely exemplary. Thus, the package 20 of this invention can be of any construction and/or shape, e.g, a simple pouch. What is important is that the material forming the package be capable of maintaining a vacuum within the package once the package is filled with the inner tube 10 and then vacuumized and sealed.

The package 20 is formed from a web of flexible stock material, e.g., polyethylene, polyester, polypropylene, metal foil, and combinations thereof in single or multiple plies, into a tubular body having a face panel 22, a back panel 24, and a pair of gussetted sides 26 and 28. The tubular body is sealed along a longitudinally extending fin 29. The gussetted side 26 is formed by a pair of gusset sections 26A and 26B and a central fold edge 26C interposed between a pair of outer fold edges 26D and 26E. The gussetted side 28 is formed by a pair of gusset sections 28A and 28B and a central fold edge 28C interposed between a pair of outer fold edges 28D and 28E.

The lower end of the package is permanently sealed, e.g., heat sealed, along a line 30 extending transversely across the width of the package close to its bottom edge 32. The top of the package, which forms its mouth 34, is sealed transversely across the entire width of the package to maintain the inner tube 10 under vacuum until the package is opened. In particular, the mouth 34 of the package 20 is arranged to be initially hermetically sealed closed along a transverse, peelable seal line 36, after the package has been filled and vacuumized.

The seal line 36 is formed in a conventional manner. For example, it can be made peelable by modifying the sealant layer, i.e., the inner surface layer, of the material forming the package with a peelable coating or incompatible additive. Alternatively, the peelable mouth can be formed in accordance with the teachings of U.S. Pat. Nos. 4,576,285 (Goglio) and/or 4,705,174 (Goglio), whose disclosures are incorporated by reference herein. Such a package includes a peel strip applied to the inner surface of the package below the top edges. The strip provides an air-tight interfacial seal which can be readily peeled apart to provide access to the interior of the package.

In any case the peelable seal line 36 extends across the width of the package slightly below the top edge 38 to seal the inner surfaces of the abutting front and rear panels to each other between the inner fold lines 26C and 28C of the pair of gussets 26 and 28, respectively. The seal line 36 also seals the marginal portions of the front panel to the abutting portions of the gussetted sides contiguous therewith and seals the marginal portions of the rear panel to the abutting portions of the gussetted sides contiguous therewith. Thus, the seal line 36 serves to isolate inner tube 10 with the package from the ambient atmosphere once the package is sealed with the inner tube therein.

As mentioned earlier, the inner tube is preferably folded or rolled up into some compact configuration so that it can fit within the hollow interior of a small package 20, e.g., a package 2 inches (4.08 cm) wide, by 1.5 inches (3.8 cm) thick, by 4.5 inches (11.4 cm) long, which is easily stowable. In the embodiment shown the inner tube is folded into a serpentine configuration of generally parallelopiped shape. In that arrangement the opposed marginal edges of each folded section of the inner tube lie in respective common planes, i.e., one set of marginal edges 10A is in a plane disposed immediately adjacent the face panel 22 of the package, while the opposed marginal edges 10B are in another, parallel plane, disposed immediately adjacent the rear panel 24 as shown in FIG. 3. Not only does this folding of the inner tube result in a compact configuration, it also serves to minimize chance of injury to the inner tube, by reducing its surface area and by compacting it into a tight, hard mass.

As should be appreciated by those skilled in the art, when the air is withdrawn from the package during the sealing thereof, the flexible material forming the package's face panel, rear panel, and gussets will intimately engage the exterior surface of the folded up inner tube 10. The inherent strength and puncture resistance of the package 20 coupled with the fact that its walls are in intimate engagement with and conform to the exterior surface of the folded inner tube "hardens" the package. This "hardness" should be sufficient in most instances to prevent a breach of the package's walls and concomitant injury to the inner tube.

In the unlikely event of such a breach, the package 20 will automatically assume a different appearance from its normal appearance to alert the user of the breach. In particular, the intimate engagement of the package's walls with the enclosed inner tube, when it is under vacuum, provides the package with an uneven exterior surface, e.g., the serpentine shape of the inner tube's folds are discernable in the form of plural ripples or dimples 22A (FIG. 1) in the surface of the front and rear panels 22 and 24, respectively, where those panels overlie respective gaps between abutting folded sections of the inner tube. Thus, when the package 20 is intact, as is normal, its outer surface will be ridged or dimpled to conform to the underlying shape of the folded inner tube.

Figure 2:
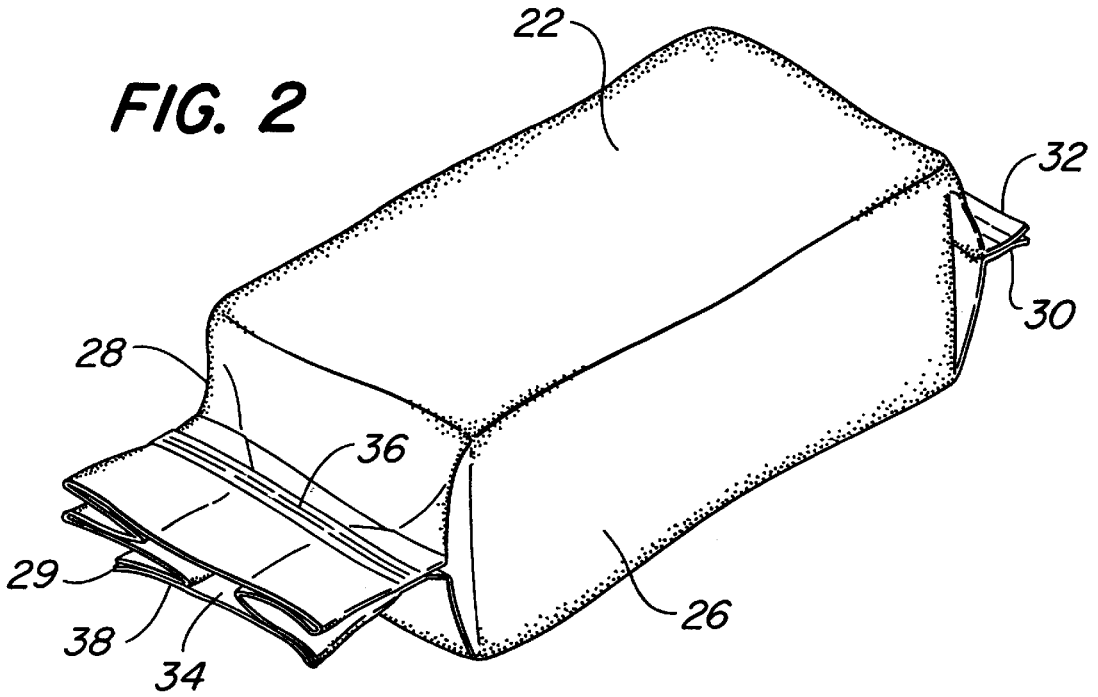
FIG. 2 is an isometric view of the package of FIG. 1 but showing its state after having been perforated or penetrated by some accidental, high force impaction, which may have punctured or otherwise compromised the integrity of the inner tube.

If the package is impacted in such a manner so as to rupture or otherwise breach its wall(s), such action would also likely result in the puncturing of the inner tube or in otherwise compromising the integrity of the inner tube. While such an occurrence is unlikely, and certainly not desirable, such a occurrence will, never the less, be evident to the user of the package, since the appearance of the surface of the package will be different than prior to the impact or injury. In this regard, a breach in the wall of the package will result in the in-rush of air into the interior of the package through the breach to result in the loss of vacuum therein. This loss of vacuum will enable the inherent resiliency or shape memory of the flexible packaging material forming the front panel 22, rear panel 24, and side gussets 26 and 26 to resume its natural flat shape, whereupon the panels 22 and 24 and the gussets 26 and 28 a will take on a much smoother appearance, like that shown in FIG. 2. Thus, upon seeing the package 20 in this smooth walled condition the user will be alerted that a loss of vacuum has occurred. If the peelable seal 36 is intact, and the package's walls assume a smooth appearance the user can then assume that the package sustained some injury to cause the loss of vacuum, and such injury to the package could have resulted in injury to the inner tube. The user can then open the package as described below to examine or otherwise check out the condition of the inner tube, to determine if it has in fact sustained injury, e.g., been punctured. If so, the inner tube can be repaired and/or replaced as is deemed appropriate under the circumstances.

If it is deemed desirable some printed instructions may be provided on the package to explain to the user that the package should have a somewhat dimpled surface appearance, and that if it does not have that appearance (e.g., has a smooth appearance), that may indicate that the integrity of the inner tube has been compromised.

As should be appreciated from the foregoing, the subject package serves to keep and protect an inner tube in a compact state ready for use when needed. Thus, when the inner tube is needed, all that is necessary to gain ingress into the package, is for the user to grasp the top marginal edges 38 of the front and rear panels 22 and 24, respectively, between his/her fingers to pull those edges apart, thereby opening the package's mouth. The folded up inner tube 10 can then be removed through the package's mouth.

It should also be appreciated by those skilled in the art that by keeping the inner tube under vacuum conditions within the interior of the package, the subject invention helps also maintain the viable condition of the rubber forming the inner tube, e.g., it prevents the rubber from drying out or otherwise losing resiliency due to oxidation or contact with contaminants.

Without further elaboration the foregoing will so fully illustrate my invention that others may, by applying current or future knowledge, adopt the same for use under various conditions of service.

I claim:

1. In combination a vacuum package and an inner tube for a vehicle, said inner tube comprising an annular hollow member which is folded up into a compact state, said vacuum package being formed of at least one panel of a flexible packaging material which is configured to form a hollow interior chamber in which said folded inner tube is located, said package having a mouth which enabled the evacuation of air from the interior of said chamber with said folded inner tube therein and was sealed thereafter, whereupon said packaging material closely conforms to the shape of said folded inner tube to hold said folded inner tube in said compact state.

2. The package of claim 1 wherein said package is arranged to be readily opened to provide ready access to said folded inner tube.

3. The package of claim 2 wherein said mouth of said package includes a pealable seal which is arranged to be readily peeled open to provide access to said folded inner tube.

4. The package of claim 1 wherein said package is formed of a material suitable of maintaining a vacuum sufficient to render the package relatively hard.

5. The package of claim 1 wherein said package is small in size.

6. The package of claim 5 wherein said package is approximately 2 inches (4.08 cm) wide, by 1.5 inches (3.8 cm) thick, by 4.5 inches (11.4 cm) long.

7. A method of packaging an inner tube for a pneumatic tire, comprising the steps of:

(a) providing a package having walls formed of a flexible material suitable for maintaining a vacuum, said package having a hollow interior;

(b) providing an inner tube within said hollow interior;

(c) evacuating said hollow interior of said package while said inner tube is located therein; and (d) sealing said package while maintaining said vacuum in said interior of said package to cause said walls of said package to closely conform to the shape of said inner tube to thereby provide an uneven surface appearance, said material forming said walls of said package automatically assuming a smoother appearance upon a loss of vacuum within said interior.

8. The method of claim 7 wherein said package includes a mouth which is arranged to be peeled open, when desired, said method additionally comprising the step of:

(e) peeling said mouth of said package open to enable said inner tube to be removed therefrom.

* * * * *